United States Patent [19]

Eshleman

[11] Patent Number: 4,531,464

[45] Date of Patent: Jul. 30, 1985

[54] PARTICLE FUEL DIVERSION STRUCTURE

[75] Inventor: Roger D. Eshleman, Waynesboro, Pa.

[73] Assignee: Eshland Enterprises, Inc., Greencastle, Pa.

[21] Appl. No.: 632,998

[22] Filed: Jul. 20, 1984

[51] Int. Cl.[3] ..... F23G 3/00

[52] U.S. Cl. ..... 110/259; 110/102; 110/118; 110/211

[58] Field of Search ..... 110/210, 211, 212, 214, 110/229, 248, 256, 259, 310, 311, 102, 118

[56] References Cited

U.S. PATENT DOCUMENTS

| | | | |
|---|---|---|---|
| 2,069,584 | 2/1937 | Lorton | 110/259 X |
| 3,861,332 | 1/1975 | Itasaka | 110/259 X |
| 4,048,927 | 9/1977 | Agustin et al. | 110/210 X |
| 4,274,341 | 6/1981 | Ozaltay | 110/229 |
| 4,452,611 | 6/1984 | Richey | 110/229 X |

*Primary Examiner*—Edward G. Favors

*Attorney, Agent, or Firm*—Michael R. Swartz; John R. Flanagan

[57] ABSTRACT

A particle fuel burning furnace has an upper combustion chamber for holding a pile of particle fuel and burning the same from the bottom thereof. The furnace also includes a lower combustion chamber for afterburning combustible gases given off by the burning of solid fuel in the upper chamber and a series of spaced apart vertically-extending passageways arranged in a row and interconnecting the upper and lower chambers for communicating the combustible gases from the upper to the lower chamber. A first improved feature relates to a particle fuel delivery control device which operates an auger for filling the upper chamber with particle fuel to a desired level. A beam of light is transmitted and reflected between a photoelectric cell and reflector respectively of the device. When the particle fuel pile has grown in height during filling to the desired level the light beam is interrupted and filling is terminated. A second improved feature relates to a particle fuel diversion structure positioned in spaced relationship above and overlying the row of passageways. The structure forms a horizontal slot which extends laterally from the passageways which prevents particles of fuel from falling through the passsageways and relocates the flame which burns the particle fuel pile from the bottom to a region away from the passageways.

6 Claims, 2 Drawing Figures

PARTICLE FUEL DIVERSION STRUCTURE

CROSS REFERENCE TO RELATED APPLICATION

Reference is hereby made to the following copending U.S. application dealing with subject matter related to the present invention: "Particle Fuel Delivery Control Device" by Roger D. Eshleman, U.S. Ser. No. 632,925, filed July 20, 1984.

BACKGROUND OF THE INVENTION

1. Field of the Invention

The present invention relates generally to particle fuel burning furnaces and, more particularly, is concerned with a structure mounted above passageways interconnecting upper and lower combustion chambers in the furnace which diverts particle fuel flow in the upper chamber away from the passageways.

2. Description of the Prior Art

In times of constantly increasing energy costs, the utilization of waste materials as fuel to produce energy is of increasing importance. Waste materials are amply available from various sources, for example, agricultrual, forestry and industrial operations.

Many different furnaces (including incinerators and the like) appear in the prior art for burning conventional types of fuel, such as coal and wood, as well as waste or by-product types of particle fuel, such as sawdust, pulverized trash and wood chips. Representative of the prior art are the furnaces disclosed in Barnett (U.S. Pat. No. 2,058,945), Evans (U.S. Pat. No. 3,295,083), Midkiff (U.S. Pat. No. 3,822,657), Kolze et al (U.S. Pat. Nos. 3,865,053; 4,311,102; 4,377,115), Culpepper, Jr. (U.S. Pat. No. 3,932,137), Leggett et al (U.S. Pat. No. 3,951,082), Probsteder (U.S. Pat. No. 4,218,980), Payne et al (U.S. Pat. No. 4,378,208), Voss (U.S. Pat. No. 4,385,567) and Ekenberg (U.S. Pat. No. 4,430,949).

Another prior art furnace for burning waste product particle fuel is manufactured by Eshland Enterprises, Inc. of Greencastle, Pa., under the trademark "Wood Gun". Generally referred to as a wood gasification boiler, it has an insulated housing in which an upper, primary particle fuel retention and combustion chamber and a lower, secondary or afterburning combustion chamber are formed by refractory materials. A series of generally verically extending passageways interconnect the bottom of the upper chamber with the top of the lower chamber. A quantity of waste particle fuel delivered into the upper chamber of the boiler through a fuel inlet in the top of the housing falls toward the bottom of the upper chamber and forms into a pile of fuel particles. The pile of particle fuel is ignited and burns from the bottom adjacent the location of the passageways. Periodically, the pile is replenished by delivery of additional particle fuel through the top fuel inlet of the housing.

Combustible gases generated as by-products from the burning of the particle fuel in the upper, primary chamber, along with air introduced into the upper portion of the primary chamber above the pile of fuel, are drawn downward through the passageways into the lower, secondary chamber by a draft inducing fan which creates a negative pressure drop in the lower chamber relative to the upper chamber. A suitable heat recovery unit is connected to the lower combustion chamber for capturing much of the heat produced by burning the combustible gases therein.

The above-described boiler has proven to be an efficient and economical way to convert waste products into usable heat energy. For the most part, the overall performance of the Eshland WOOD GUN wood gasification boiler has met and even surpassed expectations since its introduction. However, from time to time in any product, and the Eshland boiler is no exception, a need arises to make certain improvements which will solve problems which crop up and increase performance and productivity even further.

SUMMARY OF THE INVENTION

The preferred embodiment of a waste product particle fuel burning furnace, as disclosed herein, includes several improved features which meet the aforementioned needs. While the improved features are particularly adapted for working together to facilitate the burning of waste products in an improved manner, it is readily apparent that such features may be incorporated either singly or together in a particle fuel burning furnace.

One of the improved features comprises the invention claimed in the co-pending application, crossreferenced above; however, both improved features are illustrated and described herein for facilitating a complete and thorough understanding of the feature comprising the present invention.

The present invention relates to a particle fuel diversion structure incorporated into the particle fuel burning furnace at the bottom of the upper combustion chamber adjacent the passageways leading from the upper to the lower combustion chambers. In absence of the diversion structure of the invention, several problems arise which adversely affect the long term operation of the furnace. First, some particles of fuel fall through the passageways into the lower combustion chamber during the normal course of operation with the result that air flow and combustion are impeded, thereby reducing the heat output of the furnace. Frequent cleaning is then required to remove the material deposited in the lower combustion chamber. Secondly, flame initiation typically occurs as the combustible gases mix with air in passing through the passageways. The high temperature flame passing across the edges of the passageways causes spalding and erosion of the edge surfaces with the result that the passageways gradually become enlarged with continued use. When the wearing process has proceeded for some time, the passageways become so large that larger pieces of fuel will fall through the passageways, thus requiring premature replacement of the refractory material which forms the lower chamber and incorporates the passageways.

The present invention elminates these problems by providing a fuel diversion structure above the passageways. The diversion structure includes an elongated fuel diverter block having a generally triangular cross section and at least a pair of spacer blocks located below either end of the diverter block which elevate the diversion block above the passageways. The unique configuration and arrangement of the diversion structure relative to the passageways creates a slot along each opposite lower edge of the block which extends to the passageways such that the slot now becomes the location of flame initiation rather than the passageways. The diverter block also provides surfaces which direct fuel particle flow away from the passageways so as to prevent small size particles of fuel from falling through the passageways or from being drawn into the lower combustion chamber by the downdraft. As a result, flame erosion takes place on the edges of the fuel diverter block rather than in the passageways and the lower chamber does not fill up with unburned fuel particle residue. The service life of the lower combustion chamber is greatly extended, and the relatively inexpensive fuel diveter block can be easily and conveniently replaced rather than the expensive refractory material of the lower combustion chamber. Also, the fuel diversion structure has the advantage of permitting the burning of finer particles, such as sawdust, shavings, and biomass pellets, than was possible heretofore.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
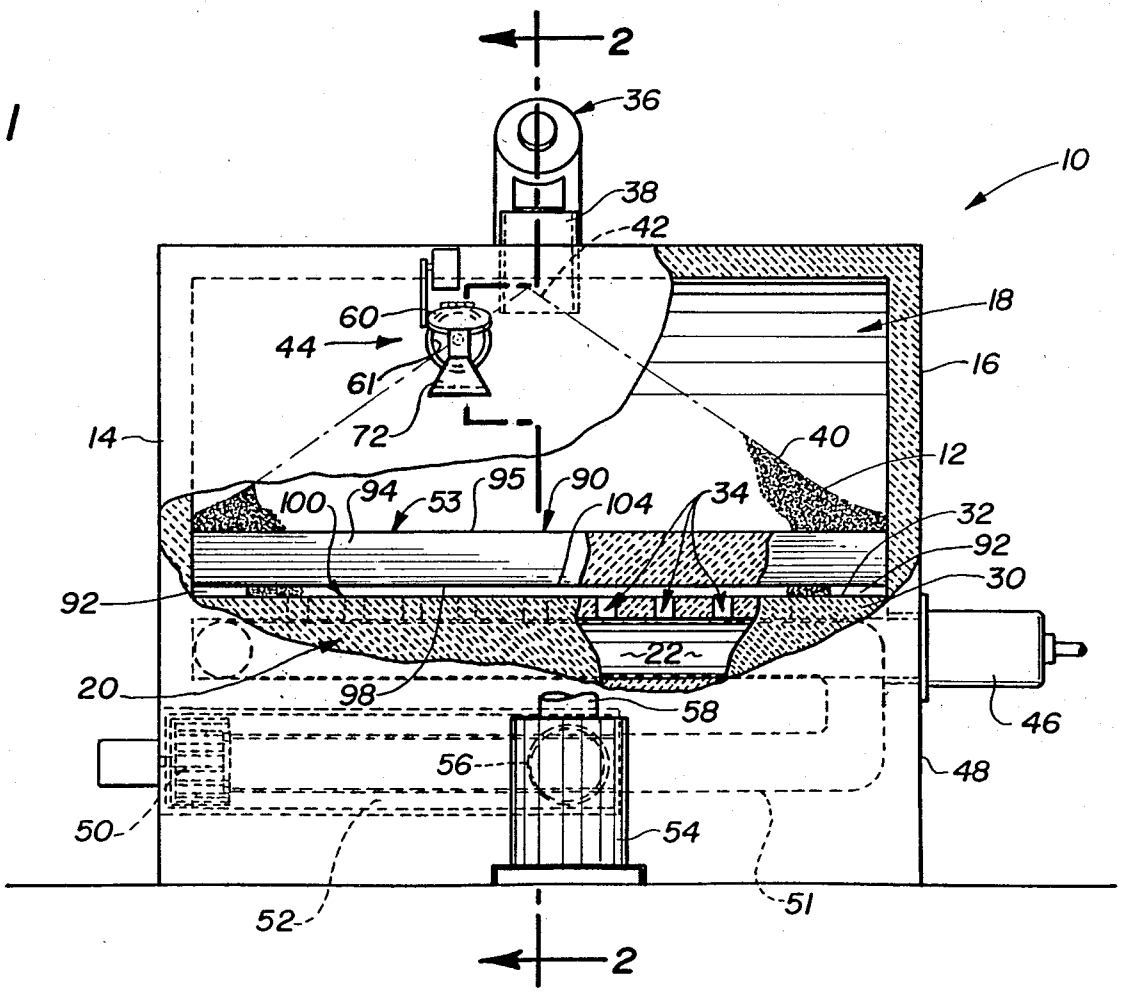
FIG. 1 is a side elevational view of the particle fuel burning furnace incorporating the improved features of the present invention, with portions broken away to show the inside of the furnace.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

In General

Figure 2:
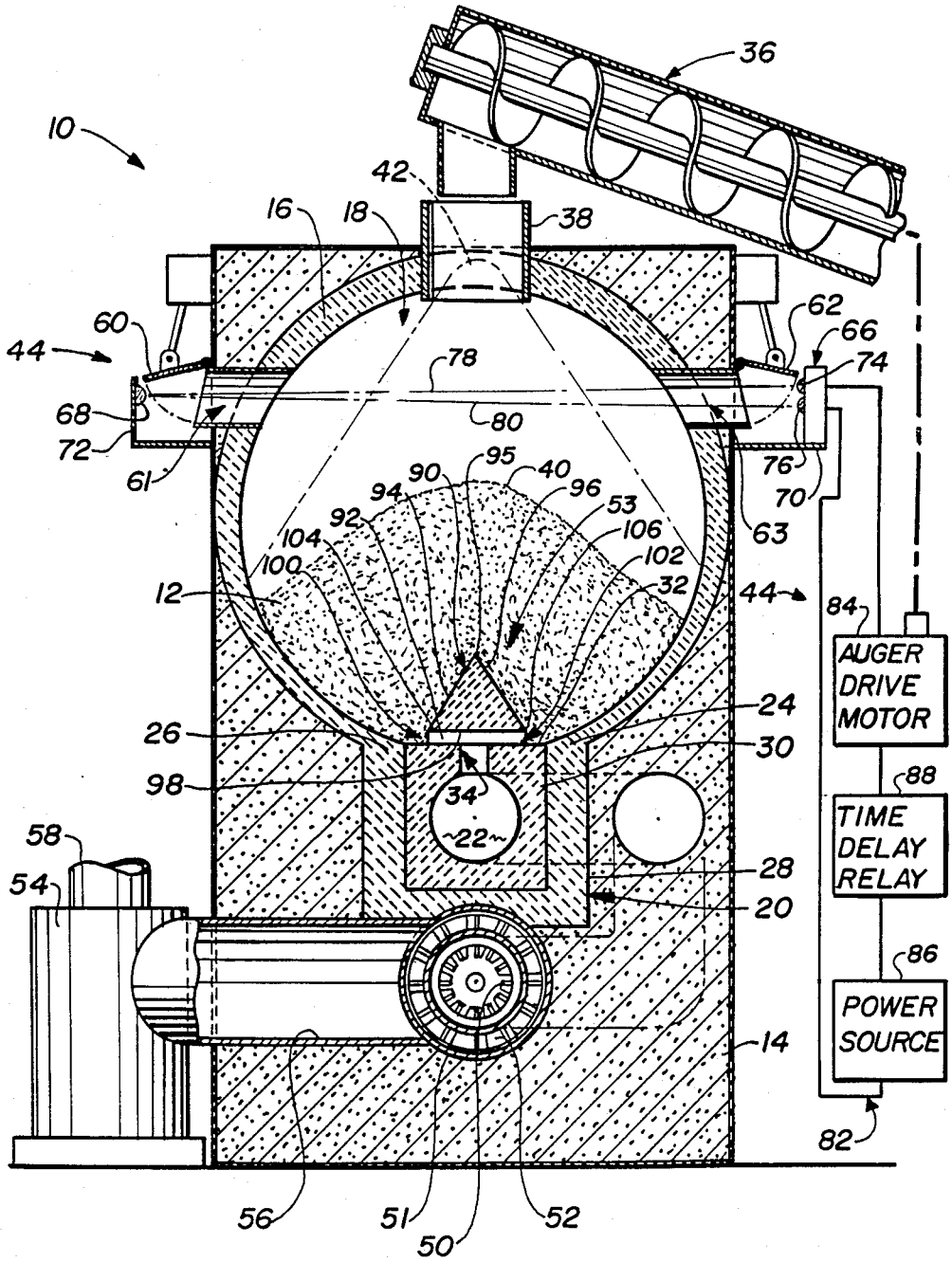
FIG. 2 is an enlarged sectional view of the furnace taken along line 2—2 of FIG. 1.

Referring now to FIGS. 1 and 2 of the drawings, there is shown a furnace, being indicated generally by the numeral 10, for burning particle fuel 12, for instance, composed of by-products of wood. The particle fuel burning furnace 10 incorporates the preferred embodiments of the improved features comprising the present invention and the other invention claimed in the above cross-referenced application.

The particle fuel burning furnace 10 includes a generally rectangular insulated jacket or housing 14 containing a cylindrical shaped lining 16 formed of refractory material which defines an upper, primary particle fuel retention and combustion chamber 18 and a rectangular shaped lining 20 also formed of refractory material which defines a lower, secondary or afterburning combustion chamber 22. Both of the upper and lower combustion chambers 18,22 are generally cylindrical in shape and extend generally parallel to one another. Since the upper chamber 18 also serves as a holding or retention chamber for the solid particle fuel 12, such as sawdust, being burned in the furnace 10, the upper chamber 18 is much larger in diameter than the lower chamber 22, although they both have substantially the same axial length.

The liner 20 defining the lower chamber 22 has a double wall construction, as seen in FIG. 2, which makes it much thicker than the liner 16 forming the upper chamber 18. The cylindrical upper chamber liner 6 is open along its bottom where its laterally spaced edges merge at 24,26 with respective spaced apart upper edges of an outer box-like wall portion 28 of the rectangular liner 20. An inner block-like wall portion 30 of the liner 20, which defines the lower chamber 22, nests within the outer wall portion 28 and at its upper surface 32 forms the bottom of the upper chamber 18.

Within the inner block-like wall portion 30 of the liner 20 and between left and right ends of the chambers 18,22 as seen in FIG. 2 is formed a series or row of spaced apart, generally vertically-entending passageways 34 which interconnect the bottom of the upper chamber 18 with the top of the lower chamber 22. The row of passageways 34 extends in a direction generally parallel to the axial direction of each of the chambers 18,22 while each individual passageway 34 extends in a direction generally perpendicular to the axial direction of the chambers.

Waste or by-product particle fuel, for instance sawdust, is delivered by any suitable means, such as an auger 36, into the upper chamber 18 of the furnace 10 through a fuel inlet 38 in the top of the housing 14 and the cylindrical lining 16. The particle fuel falls though the inlet 38 toward the bottom of the upper chamber 18 and forms into a pile 40 which covers the chamber bottom and the passageways 24. The pile 40 grows in height within the upper chamber 18 until it reaches a level, as represented by dashed line 42, at which the first improved feature employed by the furnace 10, a particle fuel delivery control device 44, is deactivated to terminate operation of the auger 36. As the pile 40 of particle fuel 12 burns and decreases in height, the device 44 is again activated, as will be explained hereinafter, to cause operation of the auger 36 for rebuilding the pile 40. Thereafter, periodically, the pile is replenished by delivery of additional particle fuel through the top fuel inlet 38 of the housing 14.

Once ignited, heat generated by a flame in the lower chamber 22 causes the pile 40 of particle fuel 12 to burn from the bottom adjacent to the location of the passageways 34. Combustible gases generated as by-products from the burning of the particle fuel in the upper chamber 18, along with air introduced into the upper portion of the upper chamber above the fuel pile 40, are drawn downward through the passageways 34 into the lower chamber 22 by a draft inducing fan 50 (FIG. 1) which communicates with the lower chamber 22 via a serially interconnected gasification tunnel 51 and swirl chamber 52. In the exemplary embodiment shown in FIG. 1, the furnace 10 is provided with an oil burner 46 mounted to its right wall 48 and in communication with an end of the lower chamber 22. The purpose of the oil burner 46 is strictly a backup alternate fuel source and it serves no function or has any effect on the burning operation of the particle fuel 12.

The second improved feature employed by the furnace 10, a particle fuel diversion structure 53, is incorporated into the furnace at the bottom of the upper chamber 18 adjacent to and overlying the passageways 34 leading from the upper chamber to the lower chamber 22. As will be explained in detail below, the structure 53 creates a pair of slots extending horizontally from the passageways 34 to the upper chamber 18 which relocate the position of the flame at the bottom of the pile 40 and prevent particles of fuel from falling through the passageways 34.

Suitable heat transfer or recovery means, such as coil tubing or a pressure vessel (not shown), is located in either or both of the refractory linings 16,20 for capturing much of the heat produced by burning the particle fuel in the upper chamber 18 and combustible gases in the lower chamber 22. Also, most of the fly ash is removed from the remaining products of combustion in the lower chamber 22 by a cyclone ash collector 54 connected in communication with the lower chamber 22 via a branch tunnel 56 (see FIG. 2) connected to the gasification tunnel 51. As the fly ash is collected in the collector 54, the exhaust gases pass to the atmosphere through exhaust conduit 58.

Absent the improved features which were briefly mentioned above and will be described in detail hereinafter, the furnace 10 as just described is generally identical to the prior art furnace manufactured by Eshland Enterprises, Inc. of Greencastle, Pa. under the trademark "WOOD GUN".

Particle Fuel Delivery Control Device

As mentioned above, the first improved feature incorporated by the particle fuel burning furnace 10 is the particle fuel delivery control device 44 which is operatively arranged in relation to the upper portion of the insulated housing 14 and of the upper chamber 18. Particularly, the device 44 includes a pair of left and right combustion air intake valves 60,62, as viewed in FIG. 2, being mounted through the insulated housing 14 and the cylindrical lining 16 and aligned in a common horizontal plane across the upper half of the upper combustion chamber 18. The fan 50 which induces the downward flow of air in the furnace 10 causes inflow of air into the upper chamber 18 through the openings 61,63 of the left and right intake valves 60,62, when they are actuated to their open conditions as seen in solid line form in FIG. 2. When the valves 60,62 are closed, as seen in the dashed line form, the upper chamber is substantially sealed. The valves are thermostatically controlled in a known manner to open when the temperature within the furnace falls below a preset level.

The air intake valves 60,62 serve a dual function. In addition to providing for infeeding of combustion air when they are open, the valves 60,62 cooperate with the photoelectric cell 66 and a light beam reflector 68. The cell 66 is mounted to the right side of the furnace housing 14 by a bracket 70, while the reflector 68 is mounted to the left side of the housing by a bracket 72. The cell 66 and reflector 68 are positioned in alignment so as to face one another through the openings 61,63 of the air intake valves 60,62 and across the upper half of the upper chamber 18. The cell 66 includes an upper light beam generating element 74 and a lower light receiving element 76. The light beam travels along a first path, as represented by broken line 78, through the opening 63 of the right air intake valve 62, across the upper chamber 18, and through the opening 61 of the left air intake valve 60 to where it impinges on the reflector 68. The reflector 68 returns the beam along a second path, as represented by broken line 80, through the opening 61 of the left air intake valve 60, back across the upper chamber 18, and through the opening 63 of the right air intake valve 62 to where it impinges on the lower light receiving element 76.

The photoelectric cell 66 is connected in an electrical circuit, generally designated 82, in series with an auger drive motor 84 and a power source 86, such as an a.c. outlet, for controlling the delivery of particle fuel 12 into the upper chamber 18. The circuit 82 is closed and the auger drive motor 84 is turned on so long as the path 78,80 of the light beam across the upper chamber 18 remains uninterrupted. Particle fuel is then delivered by the auger 36 to the upper chamber 18 and the height of the pile 40 therein is increased until the pile interrupts the beam path. The valves 60,62 and photoelectric cell 66 and reflector 68 are placed so that the level 42 of the tip of the pile 40 fills and substantially closes the inlet 38 when the side of the pile interrupts the light beam path 78,80. Interruption of the light beam opens the circuit and shuts off the motor 84 which terminates operation of the auger 36 and delivery of fuel.

A time delay relay 88 is also connected in the circuit 82 in series with the photoelectric cell 66, drive motor 84 and power source 86. The relay 88 serves to prevent rapid and repeated starting and stopping of the drive motor 84. Instead, the relay 88 allows the height of the pile 40 to decrease a substantial distance before circuit 82 is again closed by the relay and the drive motor 84 turned back on. It will be readily understood that it takes a much shorter time for the upper chamber 18 to be filled up to the shut off level where the beam is interrupted than for the height of the pile 40 to decrease a corresponding distance due to burning of the fuel. Thus, for particle fuel material, such as sawdust, a time delay setting of 3–5 minutes would be normal.

Particle Fuel Diversion Structure

As briefly discussed earlier, the second improved feature, the particle fuel diversion structure 53, extends the useful life of the refractory materials in which the passageways 34 are formed and alleviates the filling of the lower chamber 22 with particles of fuel. The diversion structure 53 includes an elongated fuel diverter block 90 having a solid construction and a generally triangular cross-sectional shape and at least a pair of spacer blocks 92 located below either end of the diverter block 90 for elevating it above the the upper surface 32 of the inner wall portion 30 of the liner 20 which has the lower chamber 22 and passageways 34 formed therein.

The triangular configuration of the diverter block 90 provides a pair of surfaces 94,96 which slope downwardly and oppositely outwardly away from an upper central edge 95 of the block 90 displaced above the row of passageways 34 and thereby direct the flow of particles of fuel 12 away from the passageways 34 so as to prevent small particles from falling through the passageways or from being drawn into the lower chamber 22 by a downdraft. Further, the triangular configuration of the diverter block 90 and the elevation of the diverter block 90 by the spacer blocks 92 above the liner 20 provides a bottom surface 98 on the block 90 which is spaced above the upper surface 32 of the liner 20 so as to create a pair of slots 100,102 which extend from each opposite lower lateral edge 104,106 of the diverter block 90 to the passageways 34. The slots 100,102 become the location of the flame burning the particle fuel in the upper chamber 18 rather than the passageways 34 which was the case in absence of the diverter block 90. As a result of the configuration and placement of the diversion structure 53, flame erosion takes place on the lateral edges 104,106 of the diverter block 90 rather than in the passageways 34. The service life of the refractory material comprising the lower chamber 22 is greatly extended, while a relatively inexpensive diverter block can now be replaced very easily on a periodic basis.

It is thought that the improved features of the particle fuel burning furnace of the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. In a particle fuel burning furnace having an upper particle fuel holding and combustion chamber, a lower combustible gas afterburning chamber and means forming at least one passageway interconnecting a bottom of said upper chamber and a top of said lower chamber, a particle fuel diversion structure comprising:

(a) an elongated fuel diverter block; and (b) means disposing said diverter block in said upper chamber in spaced relationship above and overlying said passageway;

(c) said diverter block coacting with said bottom of said upper chamber to form a slot which extends laterally away from said passageway while providing communication between said upper chamber and said passageway, said laterally-extending slot preventing particles of fuel from falling through said passageway and relocating combustion of said particle fuel which occurs at the bottom thereof in said upper combustion chamber to a region thereof away from said passageway.

2. The diversion structure as recited in claim 1, wherein said diverter block has a generally triangular cross-sectional shape which provides a pair of surfaces which slope downwardly and oppositely outward away from said passageway to direct flow of particles of fuel in said upper chamber away from said passageway.

3. The diversion structure as recited in claim 2, wherein said generally triangular cross-sectional shape of said diverter block further provides a bottom surface spaced above said bottom of said upper chamber which forms said slot.

4. The diversion structure as recited in claim 1, wherein said disposing means takes the form of a pair of spacer blocks positioned between said bottom of said upper chamber and opposite ends of said diverter block.

5. In a particle fuel burning furnace having an upper particle fuel holding and combustion chamber, a lower combustible gas afterburning chamber and means forming a series of generally vertically extending spaced-apart passageways arranged in a row and interconnecting a bottom of said upper chamber and a top of said lower chamber, a particle fuel diversion structure comprising:

(a) an elongated fuel diverter block having a solid construction; and (b) spacer means positioning said diverter block in spaced relationship above and overlying relationship along said series of passageways;

(c) said diverter block having a pair of lateral lower opposite edges and a lower surface extending between said edges and spaced above said bottom of said upper chamber so as to create therewith a generally horizontal slot which extends in opposite lateral directions away from said series of passageways, said horizontal slot preventing particles of fuel from falling through said passageway and relocating combustion of said particle fuel which occurs at the bottom thereof in said upper chamber to a region thereof away from said series of passageways.

6. The diversion structure as recited in claim 5, wherein said diverter block also has an upper central edge displaced above said series of passageways and a pair of surfaces which slope downwardly and oppositely outward from said upper edge to said respective lower lateral opposite edges so as to direct flow of particles of fuel away from said series of passageways.

* * * * *